US011274010B2

(12) United States Patent
Okada

(10) Patent No.: US 11,274,010 B2
(45) Date of Patent: Mar. 15, 2022

(54) SHEET POST-PROCESSING APPARATUS AND IMAGE FORMING SYSTEM EQUIPPED WITH SAME

(71) Applicant: KYOCERA Document Solutions Inc., Osaka (JP)

(72) Inventor: Rina Okada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 94 days.

(21) Appl. No.: 16/983,952

(22) Filed: Aug. 3, 2020

(65) Prior Publication Data

US 2021/0039912 A1 Feb. 11, 2021

(30) Foreign Application Priority Data

Aug. 7, 2019 (JP) ..... JP2019-145019

(51) Int. Cl.
*B65H 39/10* (2006.01)
*B65H 37/04* (2006.01)
*G03G 15/00* (2006.01)

(52) U.S. Cl.
CPC ..... *B65H 37/04* (2013.01); *B65H 39/10* (2013.01); *G03G 15/6544* (2013.01); *B65H 2301/1635* (2013.01); *B65H 2301/4382* (2013.01); *B65H 2301/51611* (2013.01); *B65H 2404/74* (2013.01); *B65H 2408/122* (2013.01); *B65H 2801/06* (2013.01); *G03G 2215/0086* (2013.01); *G03G 2215/00827* (2013.01); *G03G 2215/00864* (2013.01)

(58) Field of Classification Search
CPC . B65H 9/04; B65H 9/10; B65H 9/101; B65H 37/04; B65H 2301/51611; B65H 2301/51616; B65H 2301/1635; B65H 2801/27; B65H 2801/06; G03G 15/6544; G03G 2215/00827; G03G 2215/00852; G03G 2215/00864; B31F 1/07; B31F 5/02; B31F 2201/0707; B31F 2201/0754
USPC ..... 270/58.07, 58.08, 58.09, 58.12, 58.17
See application file for complete search history.

(56) References Cited

U.S. PATENT DOCUMENTS 8,226,079 B2 * 7/2012 Ozawa ..... B65H 31/34 270/58.09
9,139,397 B2 * 9/2015 Sato ..... B31F 5/00
9,162,844 B2 * 10/2015 Kakutani ..... B65H 37/04
9,221,291 B2 * 12/2015 Kubo ..... B42B 4/00
(Continued)

FOREIGN PATENT DOCUMENTS

JP 2016-108136 A 6/2016

*Primary Examiner* — Leslie A Nicholson, III
(74) *Attorney, Agent, or Firm* — Stein IP, LLC

(57) ABSTRACT

A sheet post-processing apparatus includes a first stapler and a second stapler having different thicknesses of sheets on which a binding process can be performed. A control unit can perform a manual staple mode. If the first stapler is selected as a stapler for performing the binding process in the manual staple mode, the control unit controls the alignment member moving mechanism to move alignment members to a position defining a first insertion position for guiding the sheets to a first placing position. If the second stapler is selected, the control unit controls the alignment member moving mechanism to move the alignment members to a position defining a second insertion position for guiding the sheets to a second placing position.

6 Claims, 9 Drawing Sheets

(56) References Cited

U.S. PATENT DOCUMENTS

| | | | | |
|---|---|---|---|---|
| 9,340,391 | B2 * | 5/2016 | Obuchi | B65H 31/02 |
| 9,346,647 | B2 * | 5/2016 | Obuchi | G03G 21/1633 |
| 10,294,063 | B2 * | 5/2019 | Mutsuno | B65H 39/10 |
| 10,481,544 | B2 * | 11/2019 | Yoshida | H04N 1/00631 |
| 10,654,240 | B2 * | 5/2020 | Takahashi | B42B 5/00 |
| 10,899,156 | B2 * | 1/2021 | Komiyama | B42C 9/0075 |
| 11,027,567 | B2 * | 6/2021 | Sugiyama | G03G 15/6544 |
| 2016/0159605 | A1 | 6/2016 | Miyahara | B65H 37/04 |

* cited by examiner

SHEET POST-PROCESSING APPARATUS AND IMAGE FORMING SYSTEM EQUIPPED WITH SAME

INCORPORATION BY REFERENCE

This application is based upon and claims the benefit of priority from the corresponding Japanese Patent Application No. 2019-145019 filed Aug. 7, 2019, the entire contents of which are hereby incorporated by reference.

BACKGROUND

The present disclosure relates to a sheet post-processing apparatus and an image forming system equipped with the same, which stacks on a stacking tray sheets such as paper sheets with images formed by an image forming apparatus such as a copier or a printer, and perform a binding process on the sheets.

Conventionally, there is proposed a sheet post-processing apparatus that performs post-processing on sheets with images formed by an image forming apparatus. As the post-processing, for example, there is a punch hole forming process for forming punch holes (through holes) in the sheet after image formation, a binding process for stacking a plurality of the sheets and binding the same with a stapler, or the like. In the sheet post-processing apparatus, the sheets after the post-processing such as the binding process are discharged by a discharge roller pair onto a discharge tray through a discharge outlet.

Further, in recent years, there is also proposed a sheet post-processing apparatus in which a user manually inserts sheets through a discharge outlet, and a binding process (manual stapling process) with a stapler is performed on the inserted sheets. For instance, the following technique is known. Specifically, in a structure including a first stapler that performs the binding process using staples and a second stapler that performs the binding process without using staples as binding means, a stacking position of the sheets is the same but a binding position is different between a case where the binding process (a normal binding process) is performed by the binding means on sheets discharged from an image forming apparatus and a case where the manual stapling process is performed. If the binding process is performed again at a binding position close to that of the former binding process, binding strength may be weak. As described above, by performing the manual stapling process at a binding position different from that of the normal binding process, it is possible to bind with an appropriate binding strength even when performing the manual stapling process again on the sheets that are bound once before.

SUMMARY

A sheet post-processing apparatus according to one aspect of the present disclosure includes a stacking tray on which a conveyed sheet is stacked, an alignment member capable of moving in a sheet width direction perpendicular to a conveying direction so as to align a plurality of sheets stacked on the stacking tray, a first stapler for performing a first binding process to bind on a rear edge of the aligned sheets, a second stapler for performing a second binding process different from the first binding process to bind on a rear edge of the aligned sheets, an alignment member moving mechanism for moving the alignment member, a discharge roller pair for conveying the sheets bound by the stapler so as to discharge the sheet onto a discharge tray through a discharge outlet, and a control unit for controlling the first and second staplers and the alignment member moving mechanism. The alignment member is capable of aligning the sheets at a first placing position on the stacking tray and at a second placing position shifted from the first placing position by a predetermined distance in the sheet width direction. The first stapler performs a first binding process on the sheets placed at the first placing position, and the second stapler disposed outside the first stapler in the sheet width direction performs a second binding process on the sheets placed at the second placing position. The first stapler and the second stapler have different thicknesses of the sheets which can be bound. The control unit controls the first and second staplers to respectively perform the first and second binding processes on the sheets placed on the stacking tray, and is capable of performing a manual staple mode for controlling the first and second staplers to respectively perform the first and second binding processes on sheets inserted onto the stacking tray through the discharge outlet. In the manual staple mode, if the first stapler is selected as a manual stapler, the control unit controls the alignment member moving mechanism to move the alignment member to a position defining a first insertion position in the discharge outlet for guiding the sheets to the first placing position, while if the second stapler is selected, the control unit controls the alignment member moving mechanism to move the alignment member to a position defining a second insertion position for guiding the sheets to the second placing position.

Other objects of the present disclosure and specific advantages obtained by the present disclosure will become more apparent from the description of the embodiment given below.

DETAILED DESCRIPTION

For instance, when performing the manual stapling process, a user usually does not grasp a thickness of sheets (the number of sheets) to be inserted. Therefore, for example, when performing the manual stapling process by the second stapler, if the sheets are inserted by the user and then are moved in the apparatus to a position such that the sheets can enter the front recess of the second stapler, a situation may occur in which the sheets is too thick to enter the front recess of the second stapler, and hence the binding process cannot be performed. Therefore, in order to avoid this situation, it is desirable that the user can recognize whether or not the sheets have a thickness that can be bound by the first stapler or the second stapler when the user inserts the sheets.

The present disclosure provides a sheet post-processing apparatus and an image forming system equipped with the same, including a first stapler and a second stapler having different front recess widths (heights) for receiving sheets, in which a position of the sheets when performing the binding process is different between the first stapler and the second stapler. When performing the manual stapling process, a user can easily recognize whether or not the sheets have a thickness that can be bound by the first stapler or the second stapler when the user inserts the sheets, and thus the binding process by the first stapler or the second stapler can be securely performed.

Figure 1:
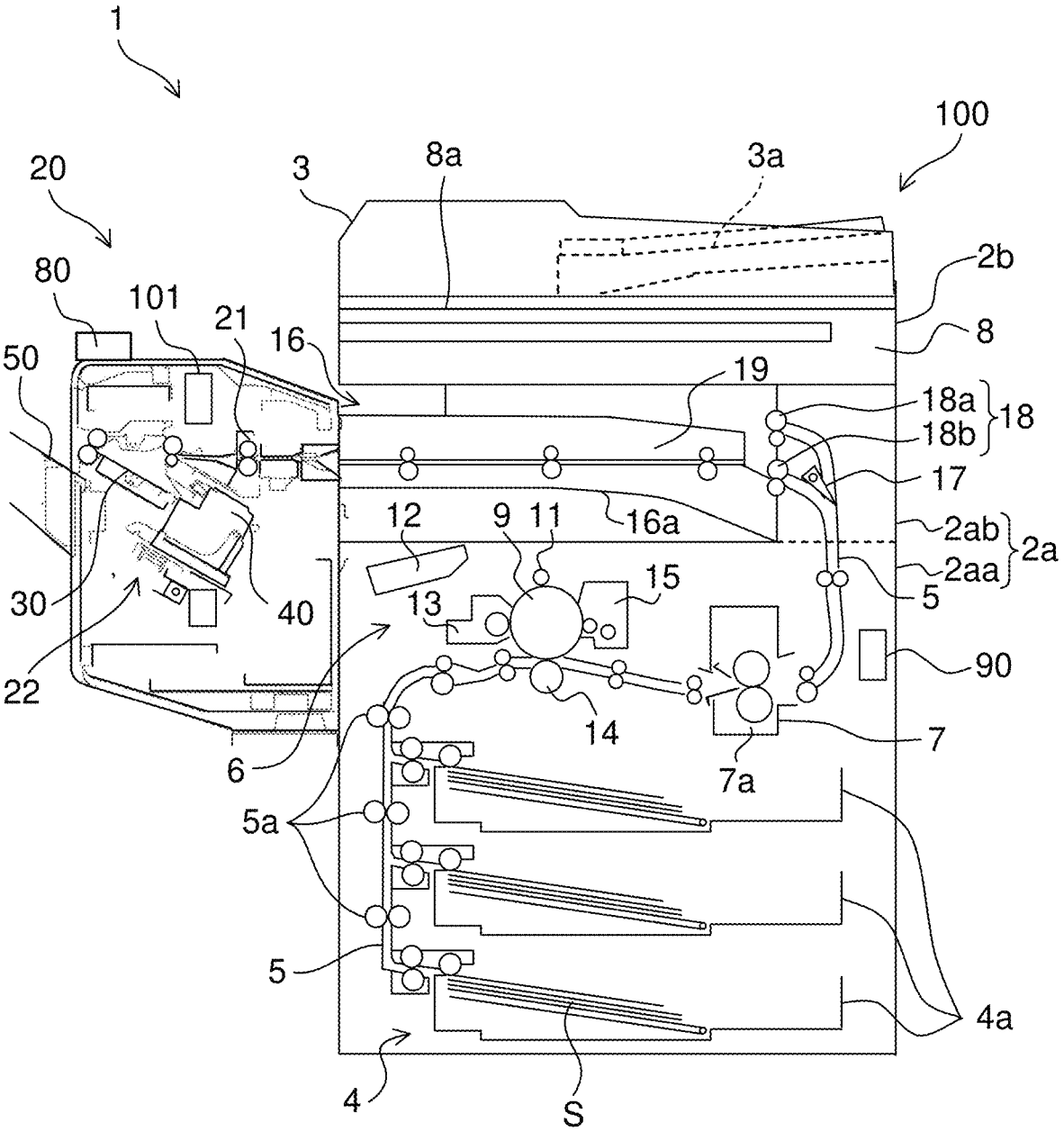
FIG. 1 is a cross-sectional view illustrating a schematic structure of an image forming system according to one embodiment of the present disclosure.

Hereinafter, with reference to the drawings, an embodiment of the present disclosure is described. FIG. 1 is a cross-sectional view illustrating a schematic structure of an image forming system 1 of this embodiment. The image forming system 1 includes an image forming apparatus 100 and a sheet post-processing apparatus 20. The image forming apparatus 100 forms an image on a sheet S as a paper sheet and supplies it to the sheet post-processing apparatus 20. As this image forming apparatus 100, a multifunction peripheral is exemplified in this embodiment, but the image forming apparatus 100 may be an image forming apparatus other than the multifunction peripheral, such as a laser printer, an inkjet printer, or a facsimile machine.

Schematic Structure of Image Forming Apparatus

The image forming apparatus 100 is a so-called in-body discharge type digital multifunction peripheral, roughly including a main body housing 2*a*, and an upper housing 2*b* disposed on the upper part of the same. The upper housing 2*b* encloses various mechanisms described later for reading a document image as an electric signal. A document feeder device 3 is attached to the upper part of the upper housing 2*b*. On the other hand, the main body housing 2*a* encloses various mechanisms described later for transferring an image onto the sheet S on the basis of the electric signal of the read document image. The sheet post-processing apparatus 20 is attached to the left side of the main body housing 2*a*.

In this embodiment, the main body housing 2*a* is constituted of a lower housing 2*aa* and a connection housing 2*ab*. The lower housing 2*aa* encloses a sheet feeding unit 4 of the sheets S, an image forming unit 6 for forming a toner image on the sheet S, a fixing unit 7 for fixing the toner image on the sheet S, and the like. The connection housing 2*ab* is positioned above the lower housing 2*aa* along the right side thereof, and is connected to the upper housing 2*b*. The connection housing 2*ab* encloses a sheet discharge unit (discharge unit) 18 for conveying the sheet S after fixing so as to discharge it from the main body housing 20.

Further, on the left side of the connection housing 2*ab* directly below the upper housing 2*b*, an in-body sheet discharge space 16 is formed, which opens largely toward the left side and the front side. In the in-body sheet discharge space 16, a relay unit 19 is disposed. The relay unit 19 receives and stacks the sheet S discharged from the left side of the connection housing 2*ab*, and conveys the sheet S to the sheet post-processing apparatus 20 when a predetermined post-processing is performed on the sheet S.

In the main body housing 2*a*, there are the sheet feeding unit 4 disposed in a lower part, a sheet conveying unit 5 disposed beside and above the sheet feeding unit 4, the image forming unit 6 disposed above the sheet feeding unit 4, and the fixing unit 7 disposed on the downstream side in the sheet conveying direction (the right side in FIG. 1) of the image forming unit 6.

The sheet feeding unit 4 includes a plurality of sheet feed cassettes 4*a*, each of which is equipped with separating and feeding means such as a sheet feed roller on the downstream side in the sheet conveying direction. When the sheet feed roller rotates, the sheets S stacked on the sheet feed cassette 4*a* are fed to the sheet conveying unit 5 one by one from the uppermost sheet S. The sheet conveying unit 5 conveys the sheet S fed from the sheet feeding unit 4 to the image forming unit 6 using conveying roller pairs 5*a*.

The image forming unit 6 and the fixing unit 7 are disposed to extend in a width direction perpendicular to the sheet conveying direction (in a front and back direction or a direction perpendicular to the paper of FIG. 1) in a main body of the image forming apparatus 100. In the upper part inside the lower housing 2*aa*, the image forming unit 6 and the fixing unit 7 are disposed in order from the left side in FIG. 1, along the conveying direction of the sheet S (from left to right direction).

The image forming unit 6 forms a predetermined toner image on the sheet S using an electrophotographic process. This image forming unit 6 includes a photosensitive drum 9 as an image carrier supported in a rotatable manner. Further, the image forming unit 6 includes a charging device 11, an exposing device 12, a developing device 13, a transferring device 14, a cleaning device 15, and a not shown charge eliminating device, which are disposed around the photosensitive drum 9 along a rotation direction thereof. The fixing unit 7 heats and presses the sheet S with the toner image transferred in the image forming unit 6, using a pair of fixing roller pair 7*a* including a heating roller and a pressure roller, which sandwich the sheet S, so that an unfixed toner image is fixed onto the sheet S.

In the upper housing 2*b*, there is disposed an image reader unit 8 that reads document image information. When reading a document manually one by one, the document feeder device 3 is opened, and the document is placed on a contact glass 8*a* disposed on the upper surface of the upper housing 2*b*. In contrast, when reading document sheets automatically one by one, the document sheets are set on a document sheet tray 3*a* of the document feeder device 3 in a closed state. In this case, the document sheets set on the document sheet tray 3*a* are automatically fed onto the contact glass 8*a* one by one sequentially. In either case, the document positioned on the contact glass 8*a* is illuminated by light from a not shown exposure lamp, and its reflected light as image light is led to a photoelectric conversion unit (CCD) via an optical system such as a reflection mirror and an imaging lens (which are not shown), so that the document image information is obtained.

A basic operation of the image forming apparatus 100 configured as described above is described below. First, the surface of the photosensitive drum 9 rotating in a counter-clockwise direction in FIG. 1 is uniformly charged by the charging device 11. Next, on the basis of image information read by the image reader unit 8, the exposing device 12 (such as a laser device) emits a laser beam to the circumference surface of the photosensitive drum 9, and hence an electrostatic latent image is formed on the surface of the photosensitive drum 9. The electrostatic latent image is supplied with toner as developer from the developing device 13 so that a toner image is formed.

Next, the sheet S from the sheet feeding unit 4 passes through the sheet conveying path 5 and is conveyed to the photosensitive drum 9 on which the toner image is formed, at a predetermined timing. Then, the toner image on the surface of the photosensitive drum 9 is transferred onto the sheet S by the transferring device 14 constituted of a transfer roller and the like. The sheet S with the transferred toner image is separated from the photosensitive drum 9 and is conveyed to the fixing unit 7. The sheet S is heated and pressed when passing though the fixing roller pair 7*a* so that the toner image is fixed.

After the transfer process of the toner image to the sheet S is finished, residual toner remaining on the circumference surface of the photosensitive drum 9 is removed by the cleaning device 15. Next, the charge eliminating device (not shown) performs a charge elimination process for eliminating residual charge on the circumference surface of the photosensitive drum 9. After that, the charging device 11 performs the charging process again on the circumference surface of the photosensitive drum 9, and then image formation is performed in the same manner.

The sheet S after passing through the fixing unit 7 is conveyed upward in the vertical direction, as it is, along the sheet conveying path 5 to inside the connection housing 2*ab*. An upper part of the sheet conveying path 5 is divided into two conveying paths of up and down paths directed to the left in the connection housing 2*ab*. A switching claw 17 disposed at the branch part switches the conveying direction of the sheet S.

A sheet discharge unit 18 is disposed in the connection housing 2*ab*. The sheet discharge unit 18 includes an upper discharge roller pair 18*a* and a lower discharge roller pair 18*b* disposed directly below the upper discharge roller pair 18*a*. The sheet S conveyed in the sheet conveying path 5 is guided by the switching claw 17 to an upper conveying path or to a lower conveying path.

The sheet S guided to the upper conveying path by the switching claw 17 is discharged leftward from the upper discharge roller pair 18*a*. On the other hand, the sheet S guided to the lower conveying path by the switching claw 17 is discharged leftward from the lower discharge roller pair 18*b*. The switching claw 17 switches the guide direction according to a main body control unit 90.

The relay unit 19 is mounted on a bottom surface 16*a* of the in-body sheet discharge space 16 in a detachable and attachable manner. In the in-body sheet discharge space 16, there is disposed a detection sensor (not shown) for detecting attachment of the relay unit 19. The detection sensor is constituted of a PI sensor or the like, which sends a detection result to the main body control unit 90.

Further, the bottom surface 16*a* is inclined upward toward the downstream side in the sheet discharge direction (toward the left in FIG. 1). When the relay unit 19 is detached from the in-body sheet discharge space 16, the bottom surface 16*a* is used as a sheet discharge tray. In this case, the detection sensor detects that the relay unit 19 is not mounted, and when the detection result is sent to the main body control unit 90, the switching claw 17 guides the sheet S to the upper discharge roller pair 18*a*. Then, the sheet S is discharged from the upper discharge roller pair 18*a* onto the bottom surface 16*a*.

In contrast, when the detection sensor detects that the relay unit 19 is mounted in the in-body sheet discharge space 16 and the detection result is sent to the main body control unit 90, the switching claw 17 guides the sheet S to the lower discharge roller pair 18*b*. Then, the sheet S discharged lower discharge roller pair 18*b* is conveyed into the relay unit 19. The sheet S conveyed into the relay unit 19 passes through the relay unit 19 and is conveyed into the sheet post-processing apparatus 20.

Note that it is also possible to display the detection result on an operation panel (not shown) so that the user can switch the guide direction of the sheet S using the operation panel. Further, an upper surface of the relay unit 19 constitutes a sheet discharge tray on which the sheet S discharged from the upper discharge roller pair 18*a* is placed.

Schematic Structure of Sheet Post-processing Apparatus

Next, a structure of the sheet post-processing apparatus 20 is described. Inside the sheet post-processing apparatus 20, there are disposed a punch hole forming device 21 for forming punch holes in the incoming sheet S, and a stapler unit 22 for stacking a plurality of incoming sheets S and performing the binding process on them. The stapler unit 22 includes a stacking tray 30 for stacking the incoming sheets S and a stapler 40 for binding the sheets stacked on the stacking tray 30. On a side surface of the sheet post-processing apparatus 20, there is disposed a discharge tray 50 that can move up and down to a position suitable for discharge of the sheets S. Individual units of the sheet post-processing apparatus 20 are controlled by a post-processing control unit 101.

The punch hole forming device 21 is disposed in an upper part of the sheet post-processing apparatus 20, and forms a plurality of punch holes along one side edge of the sheet S parallel to the conveying direction (on the front side or the back side of the apparatus), or along a rear end of the sheet S. An entrance detection sensor (not shown) is disposed substantially at the middle in the direction perpendicular to the sheet conveying direction (in the direction perpendicular to the paper of FIG. 1) on the upstream side of the punch hole forming device 21. The entrance detection sensor detects a front end of the sheet S conveyed into the sheet post-processing apparatus 20 by sheet conveying roller pairs in the relay unit 19.

Figure 2:
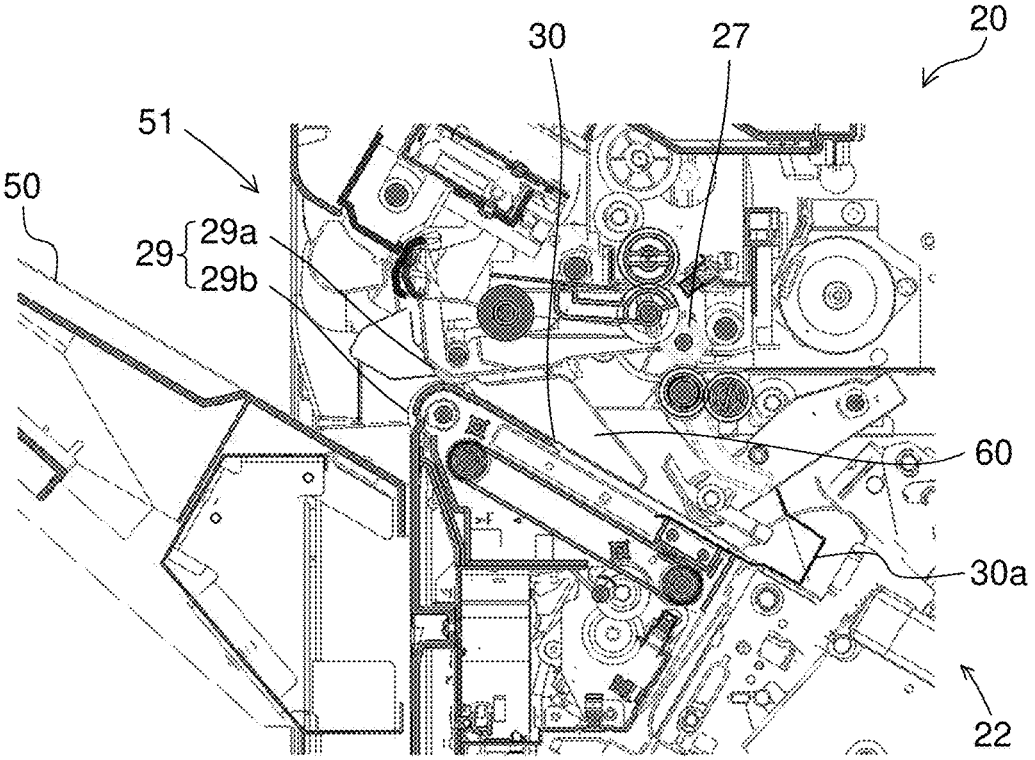
FIG. 2 is a partial cross-sectional view of a stacking tray and its vicinity in a sheet post-processing apparatus included in the image forming system.

FIG. 2 is a partial cross-sectional view of the stacking tray 30 and its vicinity in the sheet post-processing apparatus 20. A first discharge roller pair 27 is disposed on the downstream side of the punch hole forming device 21 (see FIG. 1) in the sheet conveying direction. On the upstream side of the first discharge roller pair 27, there is disposed an actuator type sheet detection sensor (not shown) for detecting passing of the sheet.

In addition, below the first discharge roller pair 27, there are disposed the stacking tray 30 described above for stacking a predetermined number of sheets conveyed by the first discharge roller pair 27, and the stapler 40 for performing the binding process on the sheets stacked on the stacking tray 30 (see FIG. 1).

Further, a second discharge roller pair 29 is disposed on the downstream side of the stacking tray 30 in the sheet conveying direction. The second discharge roller pair 29 conveys the sheets after the binding process by the stapler 40 and discharges the same onto the discharge tray 50 via a discharge outlet 51. Rollers constituting the second discharge roller pair (discharge roller pair) 29 are made up of a rubber discharge roller 29*a* capable of rotating forward and backward by a drive motor (not shown), and a resin discharge roller 29*b* driven to rotate by the discharge roller 29*a*. The discharge roller 29*a* can be displaced in the up and down direction by a discharge roller pair gap adjusting mechanism 31 (see FIG. 7). The discharge roller pair gap adjusting mechanism 31 is constituted of, for example, a roller holder having one end connected to a rotation shaft and the other end supporting the discharge roller 29*a* in a rotatable manner. Rotation of the roller holder about the rotation shaft can move the discharge roller 29*a* in the up and down direction, and thus the gap between the discharge roller 29*a* and the discharge roller 29*b* can be adjusted.

Above the stacking tray 30 on the downstream side of the first discharge roller pair 27 (on the left side of FIG. 2), there is disposed a striking member (not shown). The striking member is disposed for striking the sheet conveyed by the first discharge roller pair 27 toward the stacking tray 30 so that the sheet is along the surface of the stacking tray 30. The stacking tray 30 is disposed to be inclined downward toward the rear end of the stacked sheet (the right side of FIG. 2). When the second discharge roller pair 29 rotates backward, the sheet is pulled backward onto the stacking tray 30, and the rear end of the sheet abuts an abutting part 30*a*. In this way, the sheets are stacked on the stacking tray 30 with the rear ends aligned. Further, the stacking tray 30 is equipped with a plurality of alignment members (aligning cursors) 60 for aligning the sheets stacked on the stacking tray 30 in the sheet width direction (the direction perpendicular to the paper of FIG. 2).

Figure 3:
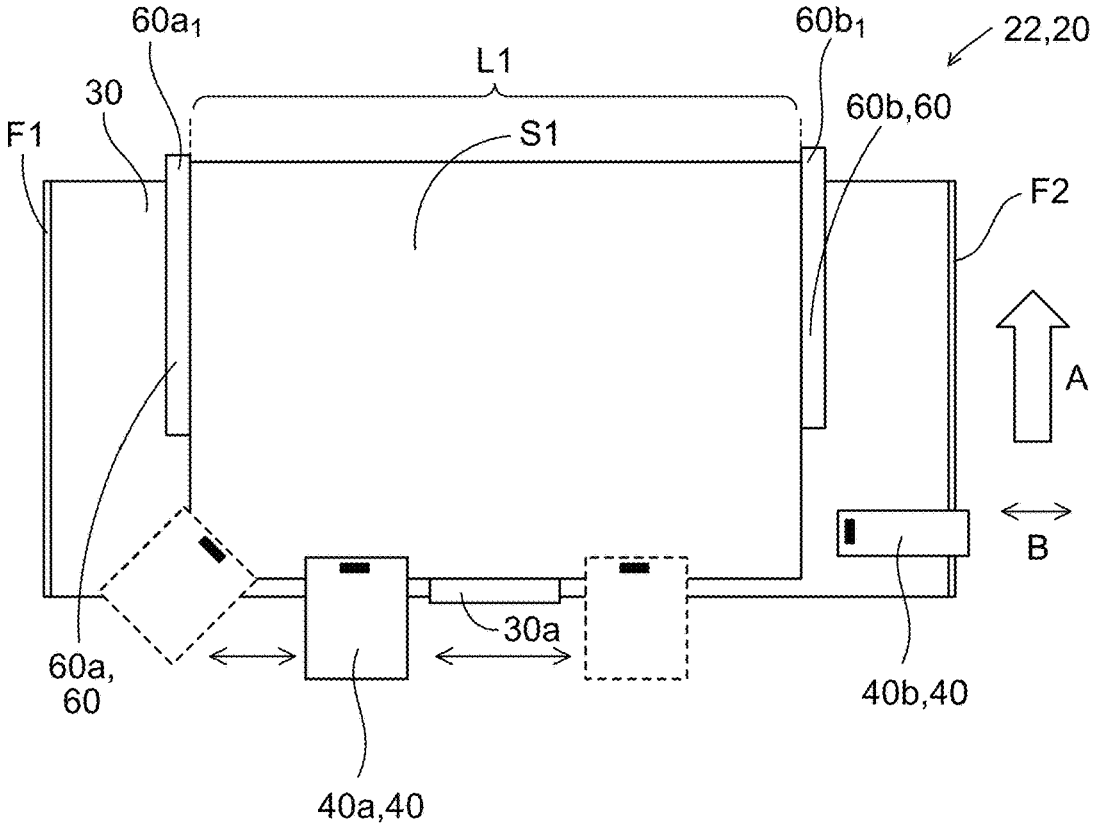
FIG. 3 is a plan view schematically illustrating a structure of the stacking tray and its vicinity, and illustrating an example of positions of a plurality of alignment members for aligning sheets stacked on the stacking tray.

FIG. 3 is a plan view schematically illustrating a structure of the stacking tray 30 and its vicinity of the stapler unit 22. Note that for convenience of description below, the conveying direction (discharge direction) of the sheets by the second discharge roller pair 29 is referred to as an A-direction, while the sheet width direction perpendicular to the A-direction is referred to as a B-direction. Both ends of the stacking tray 30 in the B-direction are supported by frames F1 and F2 of the apparatus, respectively.

The plurality of alignment members 60 of the stapler unit 22 align the plurality of sheets stacked on the stacking tray 30. This alignment member 60 is constituted of a first alignment member 60*a* and a second alignment member 60*b*. Each of the first alignment member 60*a* and the second alignment member 60*b* has an elongated shape in the A-direction. In particular, the first alignment member 60*a* and the second alignment member 60*b* extend from above the stacking tray 30 to the discharge outlet 51 in the A-direction, and ends $\mathbf{60}a_1$ and $\mathbf{60}b_1$ of them on the downstream side are disposed at an insertion position of insertion sheets P described later (see FIG. 8 and the like).

Figure 7:
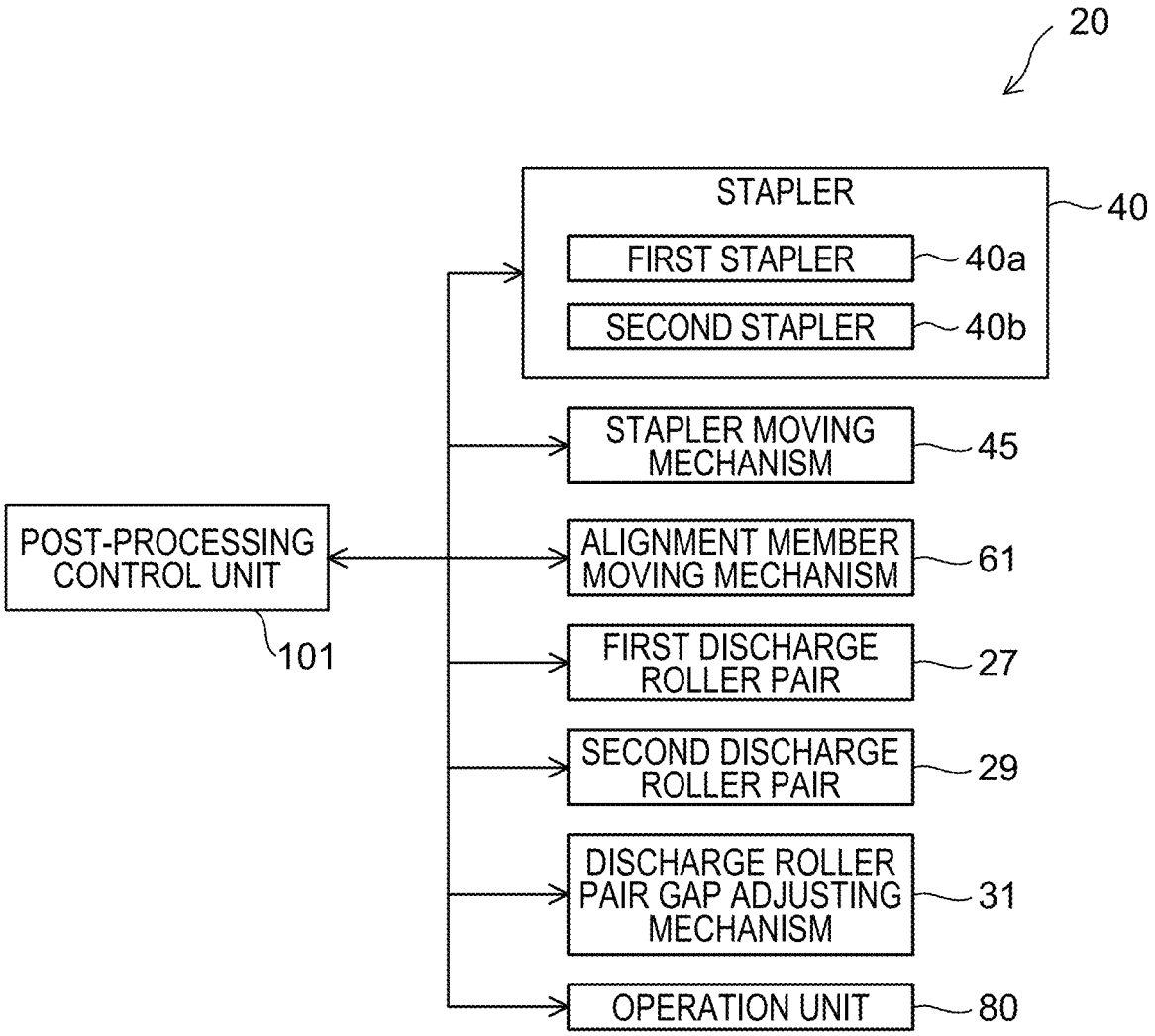
FIG. 7 is a block diagram schematically illustrating a structure of a main part of the sheet post-processing apparatus.

The first alignment member 60*a* and the second alignment member 60*b* can be moved (shifted) in the B-direction by the alignment member moving mechanism 61 (see FIG. 7). The alignment member moving mechanism 61 includes support members for supporting the first alignment member 60*a* and the second alignment member 60*b*, respectively, a motor for moving the support members, and the like. With this, the first alignment member 60*a* and the second alignment member 60*b* can be moved in the B-direction independently of each other.

Further, the stapler 40 of the stapler unit 22 performs the binding process on the sheets aligned by the plurality of alignment members 60 on the stacking tray 30. This stapler 40 includes a first stapler 40*a* and a second stapler 40*b*. The first stapler 40*a* performs the binding process on the rear edge of the sheets placed at a first placing position L1 described later using staples. The second stapler 40*b* is disposed outside the first stapler 40*a* in the B-direction and is disposed outside the first placing position L1, so as to perform the binding process different from the first stapler on the rear edge of the sheets placed at a second placing position L2. Here, the binding process different from the first stapler is considered to be a process of binding the sheets without using staples. As the binding process without using staples, for example, there are a process of pressing and embossing the stacked sheets with an edge mold so that the stacked sheets are crimped with each other, and a process of making a crease break in the thickness direction of the sheets and folding a part of the sheets along the crease break so that the sheets are bound.

In the B-direction, the first stapler 40*a* is disposed between the frames F1 and F2, and the second stapler 40*b* is disposed on the frame F2 side of the first stapler 40*a*. In other words, in the B-direction, the second stapler 40*b* is closer to the frame F2 than the first stapler 40*a*.

Figure 4:
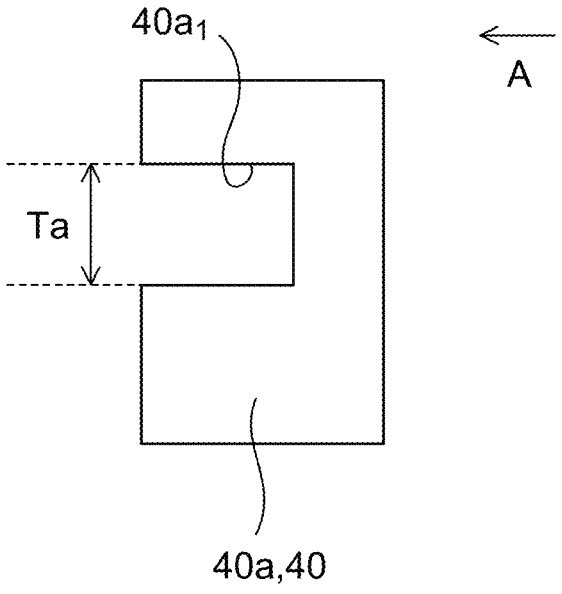
FIG. 4 is a side view of a first stapler of the sheet post-processing apparatus viewed from a sheet width direction.
Figure 5:
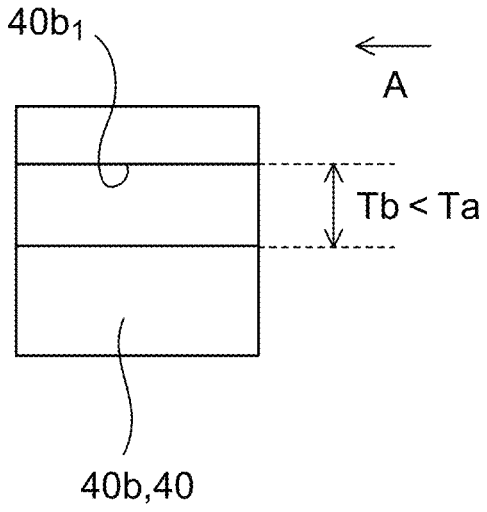
FIG. 5 is a front view of a second stapler of the sheet post-processing apparatus viewed from a sheet width direction.

Here, the sheets on which the first stapler 40*a* performs the binding process are referred to also as first sheets S1 in the following description. Further, the sheets on which the second stapler 40*b* performs the binding process are referred to also as second sheets S2 in the following description. FIG. 4 is a side view of the first stapler 40*a* viewed from the B-direction, and FIG. 5 is a front view of the second stapler 40*b* viewed from the B-direction. As illustrated in these views, a width Tb in the up and down direction (the direction perpendicular to the A-direction and the B-direction) of a front recess $\mathbf{40}b_1$ of the second stapler 40*b* (second entrance) that receives the second sheets S2 is less than a width Ta in the up and down direction of a front recess $\mathbf{40}a_1$ of the first stapler 40*a* (first entrance) that receives the first sheets S1. In other words, the width of the front recess of the second stapler 40*b*, which sandwiches the sheets to be bound in the thickness direction, is less than that of the first stapler 40*a*. Therefore, a maximum thickness of the second sheets S2 that the second stapler 40*b* can perform the binding process is less than a maximum thickness of the first sheets S1 that the first stapler 40*a* can perform the binding process. In other words, supposing that the thickness of each sheet constituting the first sheets S1 and the second sheets S2 is constant, a maximum number of the second sheets S2 that the second stapler 40*b* can perform the binding process is less than a maximum number of the first sheets S1 that the first stapler 40*a* can perform the binding process.

Figure 6:
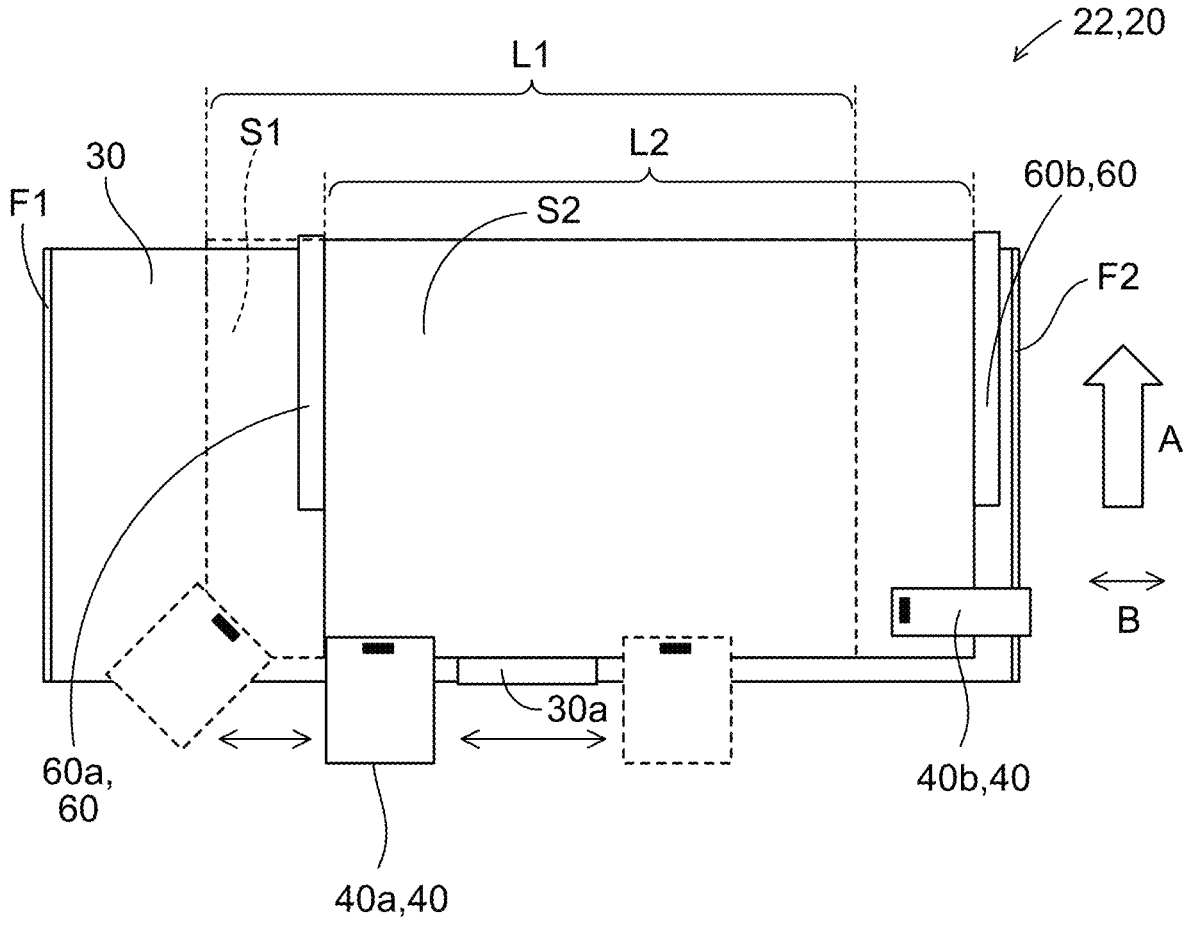
FIG. 6 is a plan view of another example of positions of the plurality of alignment members.

Therefore, as illustrated in FIG. 3, the second stapler 40*b* is disposed at a position that does not cause an interference with the first sheets S1 that are bound by the first stapler 40*a*, namely, at a position outside the first sheets S1 in the B-direction. Therefore, as illustrated in FIG. 6, the first placing position L1 and the second placing position L2 are shifted from each other in the B-direction. Note that the first placing position L1 means the rectangular area in which the first sheets S1 are aligned by the first alignment member 60*a* and the second alignment member 60*b* and is placed on the stacking tray 30, when the first stapler 40*a* binds the first sheets S1 (just before binding). Further, the second placing position L2 is the position shifted from the first placing position by a predetermined distance in the sheet width direction (B-direction), and it means the rectangular area in which the second sheets S2 are aligned by the first alignment member 60*a* and the second alignment member 60*b* and is placed on the stacking tray 30, when the second stapler 40*b* binds the second sheets S2 (just before binding).

The first stapler 40*a* is moved in the B-direction by a stapler moving mechanism 45 (see FIG. 7). The stapler moving mechanism 45 includes a rail along which the first stapler 40*a* is moved in the B-direction, a support member for supporting the first stapler 40*a*, and a motor for moving the support member along the rail in the B-direction. As the stapler moving mechanism 45 moves the first stapler 40*a* in the B-direction, the first stapler 40*a* can perform the binding process on the first sheets S1 at a plurality of positions in the B-direction.

Post-processing Operation on Sheets Supplied from Image Forming Apparatus

Next, an operation of the sheet post-processing apparatus 20 when it performs post-processing on the sheet supplied from the image forming apparatus 100 is described.

When the sheet after image formation performed in the image forming apparatus 100 is conveyed into the sheet post-processing apparatus 20, if punch hole formation is instructed, the punch hole forming device 21 forms punch holes in the conveyed sheet at predetermined positions (e.g. two positions along the side edge on the front side of the apparatus). If the punch hole formation is not instructed, the sheet passes through the punch hole forming device 21 as it is.

Then, the sheet is conveyed by the first discharge roller pair 27 further to the downstream side. In this case, the discharge roller pair gap adjusting mechanism 31 moves and sets the discharge roller 29*a* at a position apart upward from the discharge roller 29*b* (a retraction position). In this way, the sheet conveyed by the first discharge roller pair 27 passes through the gap between the discharge roller 29*a* and the discharge roller 29*b* and protrudes from the second discharge roller pair 29 to the discharge tray 50 side.

At a timing when the rear end of the sheet passes the first discharge roller pair 27, the discharge roller pair gap adjusting mechanism 31 moves the discharge roller 29*a* downward so that the discharge roller 29*a* and the discharge roller 29*b* sandwich the sheet. After that, the striking member is driven so that the sheet is along the stacking tray 30. In this state, the discharge roller 29*a* is rotated backward so that the sheet is pulled back along the stacking tray 30 and the rear end thereof is aligned by the abutting part 30*a*.

On the other hand, the alignment member moving mechanism 61 works so that the first alignment member 60*a* and the second alignment member 60*b* are positioned outside the first placing position L1 in the B-direction. Every time when the sheet is stacked at the first placing position L1 on the stacking tray 30, the alignment member moving mechanism 61 repeats the aligning operating of moving the first alignment member 60*a* and the second alignment member 60*b* in the B-direction so that the sheet is aligned.

When stacking of the sheets on the stacking tray 30 is finished, if the binding process by the first stapler 40*a* is designated by an operation unit 80 described later (see FIGS. 1 and 7), the first stapler 40*a* is moved to a desired position on the first sheets S1 placed and aligned at the first placing position L1, and the first stapler 40*a* performs the binding process. After that, the second conveying roller pair 29 discharges the first sheets S1 onto the discharge tray 50. Note that if the number of the first sheets S1 is large, it may be possible to move the abutting part 30*a* (see FIG. 3 and the like) in the A-direction so as to discharge the first sheets S1 after the binding process. Further, it may be possible to use both the rotation of the second conveying roller pair 29 and the movement of the abutting part 30*a* so as to discharge the first sheets S1.

In contrast, if the binding process by the second stapler 40*b* is designated by the operation unit 80, the alignment member moving mechanism 61 moves the first alignment member 60*a* and the second alignment member 60*b* in the B-direction so as to move the sheets stacked on the first placing position L1 to the second placing position L2. Then, the second stapler 40*b* performs the binding process on the sheets (the second sheets S2) placed at the second placing position L2. After the binding process, the second sheets S2 are discharged onto the discharge tray 50 by the rotation of the second conveying roller pair 29 and/or the movement of the abutting part 30*a* in the A-direction.

Detailed Structure of Sheet Post-processing Apparatus

Next, details of the sheet post-processing apparatus 20 of this embodiment are described. FIG. 7 is a block diagram schematically illustrating a structure of a main part of the sheet post-processing apparatus 20 of this embodiment. In addition to the structure described above, the sheet post-processing apparatus 20 further includes the operation unit 80.

The operation unit 80 is operated when the user selects a manual staple mode, and is operated by the user when the first stapler 40*a* or the second stapler 40*b* is selected as the stapler 40 for performing the binding process in the manual staple mode. For instance, this operation unit 80 include a liquid crystal display device with a touch panel and mechanical buttons, and is disposed on the upper surface of a cabinet of the sheet post-processing apparatus 20 (see FIG. 1).

Here, the "manual staple mode" is an operation mode in which the user manually insert the sheets onto the stacking tray 30 through the discharge outlet 51 of the sheet post-processing apparatus 20, and the stapler 40 performs the binding process on the inserted sheets (hereinafter referred to also as "insertion sheets"). When the manual staple mode is selected by the operation unit 80, the image forming apparatus 100 stops operations of the conveying rollers for conveying the sheet and the discharge rollers (such as the first discharge roller pair 27). Note that setting of the manual staple mode by the operation unit 80 must be performed during stop of job of the image forming apparatus 100. In other words, the manual staple mode cannot be set on the sheet post-processing apparatus 20 during the image forming operation. Further, when the manual staple mode is selected by the operation unit 80, the first alignment member 60*a* and the second alignment member 60*b* are positioned apart from each other in the B-direction. In this way, in the B-direction, the space between the first alignment member 60*a* (particularly, the end $\mathbf{60}a_1$) and the second alignment member 60*b* (particularly, the end $\mathbf{60}b_1$) is defined as the insertion position of the insertion sheets.

Operations of the stapler 40 (the first stapler 40*a* and the second stapler 40*b*), the stapler moving mechanism 45, the alignment member moving mechanism 61, the first discharge roller pair 27, the second discharge roller pair 29, and the discharge roller pair gap adjusting mechanism 31, which are based on a user's operation to the operation unit 80, are controlled by the post-processing control unit 101 in the sheet post-processing apparatus 20. The post-processing control unit 101 is, for example, a control unit including a central processing unit (CPU), and a storage unit such as a read only memory (ROM) and a random access memory (RAM). The post-processing control unit 101 controls the binding process by the stapler 40, for example. In other words, the post-processing control unit 101 controls the stapler 40 to perform the binding process on the sheets stacked on the stacking tray 30.

Post-processing Operation in Manual Staple Mode

Next, the post-processing operation in the manual staple mode is described. When the manual staple mode is set by the operation unit 80, the post-processing control unit 101 controls the discharge roller pair gap adjusting mechanism 31 to move the discharge roller 29*a* upward, and hence the gap between the discharge roller 29*a* and the discharge roller 29*b* is increased. In this way, the user can insert the sheets into the apparatus (onto the stacking tray 30) through the gap between the discharge roller 29*a* and the discharge roller 29*b* in the discharge outlet 51 (see an arrow indicating an insertion direction in FIG. 8 and the like, for example).

Here, if the binding process by the first stapler 40*a* is selected by the operation unit 80 for example, the alignment member moving mechanism 61 moves the first alignment member 60*a* and the second alignment member 60*b* in the B-direction under control by the post-processing control unit 101, and hence the insertion position of the insertion sheets defined by the first alignment member 60*a* and the second alignment member 60*b* is set to the position corresponding to the selected first stapler 40*a*, namely the position at which a rear edge $P_R$ of the insertion sheets P are directed to the front recess $\mathbf{40}a_1$ of the first stapler 40*a* (see FIG. 4).

Figure 8:
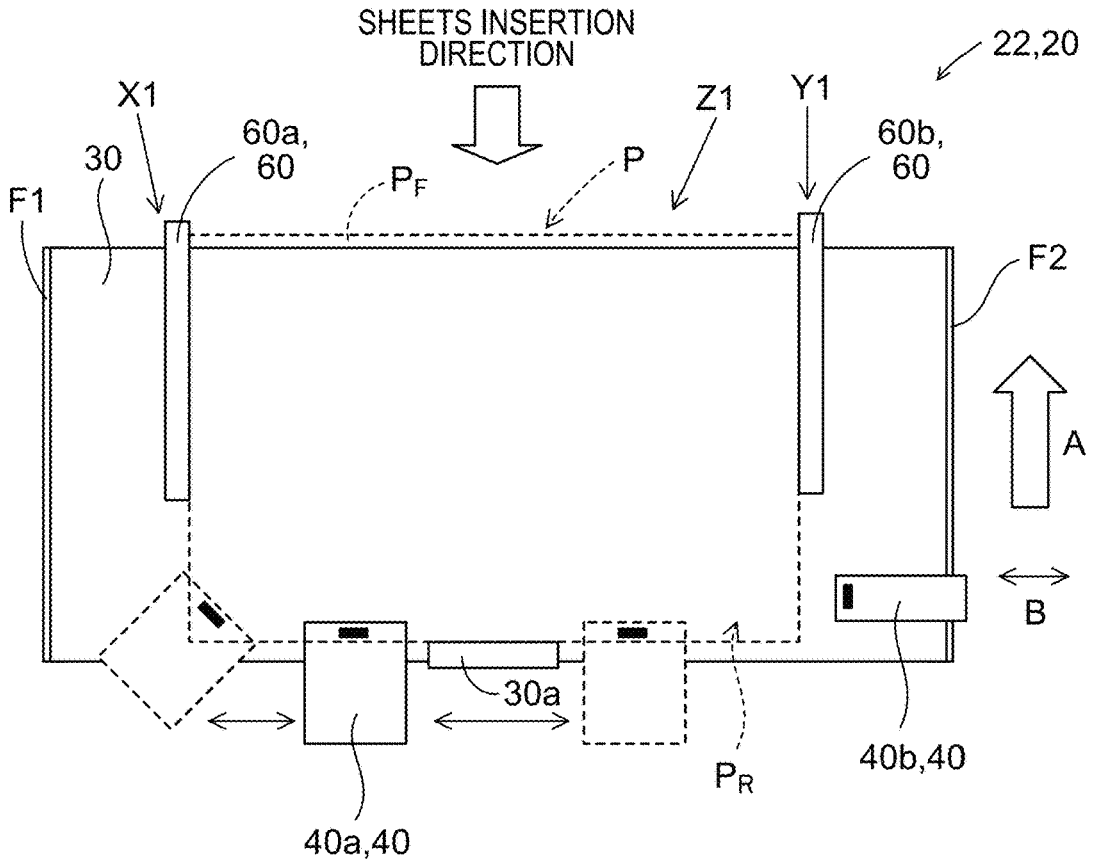
FIG. 8 is a plan view schematically illustrating positions of the plurality of alignment members when a binding process by the first stapler is selected in a manual staple mode.
Figure 9:
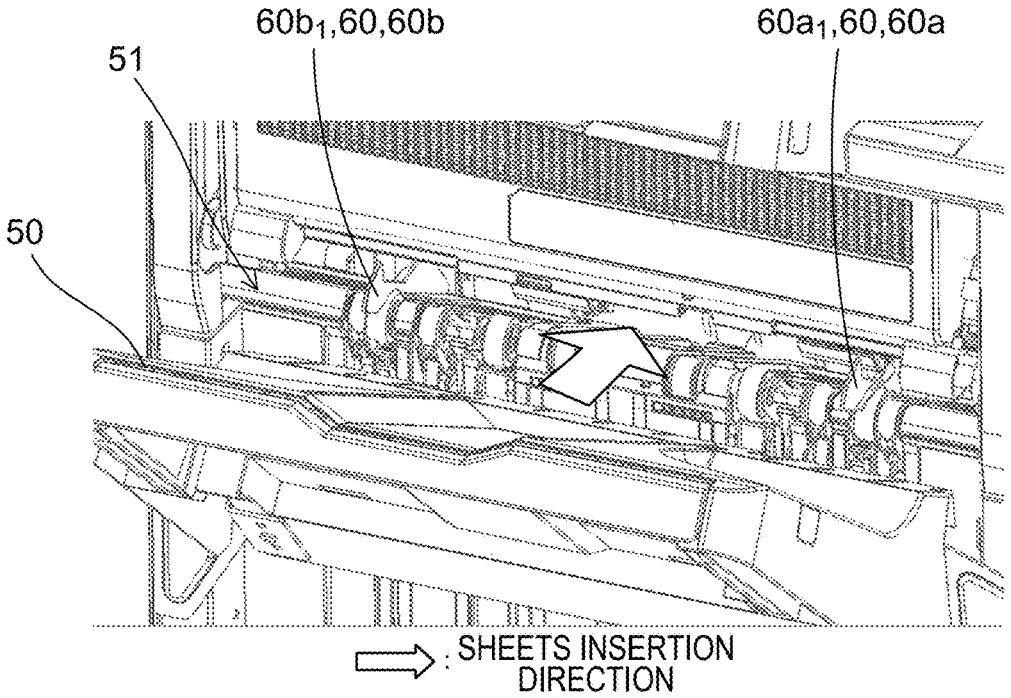
FIG. 9 is a perspective view of the plurality of alignment members illustrated in FIG. 8, viewed from a discharge tray side.

FIG. 8 schematically illustrates positions of the first alignment member 60*a* and the second alignment member 60*b* when the binding process by the first stapler 40*a* is selected in the manual staple mode. Further, FIG. 9 is a perspective view of the first alignment member 60*a* and the second alignment member 60*b* illustrated in FIG. 8, viewed from the discharge tray 50 side. As illustrated in FIGS. 8 and 9, when the first alignment member 60*a* and the second alignment member 60*b* are moved in the B-direction so as to define the insertion position (first insertion position Z1) of the insertion sheets P, the user can insert the sheets into the first insertion position Z1 between a position X1 of the first alignment member 60*a* and a position Y1 of the second alignment member 60*b* in the B-direction.

Figure 10:
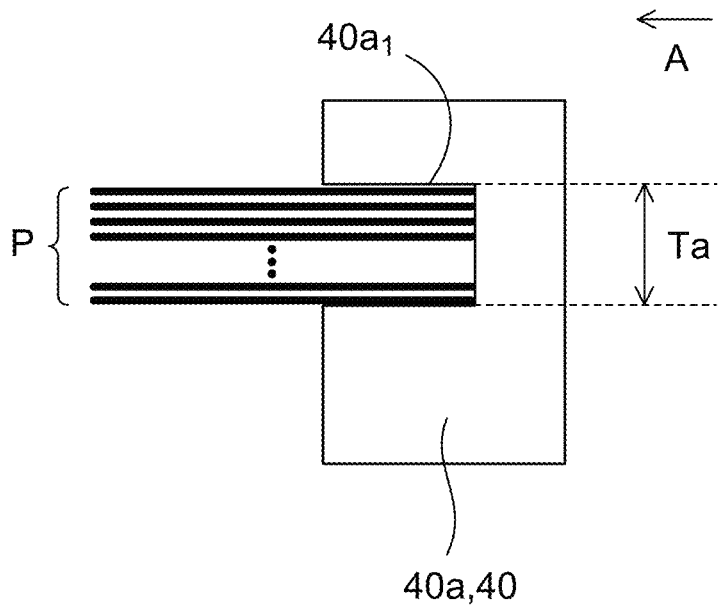
FIG. 10 is a side view of the first stapler viewed from the sheet width direction when a thickness of the insertion sheets is less than or equal to a front recess width of the first stapler.

FIG. 10 is a side view of the first stapler 40*a* viewed from the B-direction when a thickness of the insertion sheets P is less than or equal to the width Ta of the front recess $\mathbf{40}a_1$ of the first stapler 40*a*. If the thickness of the insertion sheets P is the width Ta or less, all the insertion sheets P are received in the front recess $\mathbf{40}a_1$. In other words, there are no sheets (a part of the insertion sheets P) that cannot enter the front recess $\mathbf{40}a_1$ but protrude largely from the discharge outlet 51 (see FIG. 9). In this way, the user can recognize that the thickness of the insertion sheets P is less than or equal to the thickness that can be bound by the first stapler 40*a*. Therefore, the user can operate the operation unit 80 to instruct execution of the binding process by the first stapler 40*a*, so that the first stapler 40*a* can perform the binding process of the insertion sheets P at the rear edge $P_R$ (see FIG. 8). Note that even in the state where all the insertion sheets P are received in the front recess $\mathbf{40}a_1$ of the first stapler 40*a*, an end $P_F$ of the insertion sheets P on the insertion side (see FIG. 8) protrudes a little from the second discharge roller pair 29 to the discharge outlet 51 side, and hence the user can grip the end $P_F$ of the insertion sheets P and pull the same, so that the insertion sheets P after the binding process can be pulled out from the sheet post-processing apparatus 20.

Note that the position of the insertion sheets P on the stacking tray 30, in the state where the insertion sheets P are received in the front recess $\mathbf{40}a_1$ of the first stapler 40*a* (the position of the insertion sheets P shown by a broken line in FIG. 8), is the same as the first placing position L1 illustrated in FIG. 3, namely, the position at which the sheet conveyed from the image forming apparatus 100 is stacked first.

Figure 11:
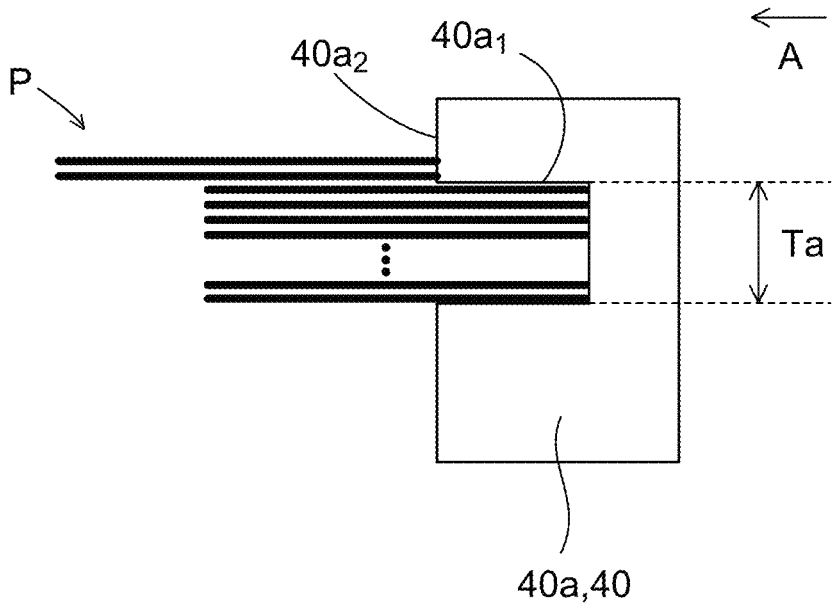
FIG. 11 is a side view of the first stapler viewed from the sheet width direction when the thickness of the insertion sheets is more than the front recess width.

FIG. 11 is a side view of the first stapler 40*a* viewed from the B-direction when the thickness of the insertion sheets P is more than the width Ta. If the thickness of the insertion sheets P is more than the width Ta, a part of the insertion sheets P are received in the front recess $\mathbf{40}a_1$, but some other sheets abut an outer surface $\mathbf{40}a_2$ outside the front recess $\mathbf{40}a_1$ and largely protrude from the discharge outlet 51 to the discharge tray 50 side. Therefore, the user can recognize that the thickness of the insertion sheets P is more than the thickness that can be bound by the first stapler 40*a*. In this case, the user can, for example, reduce the number of the insertion sheets P and inset them again through the discharge outlet 51, and hence the binding process by the first stapler 40*a* can be performed in the same manner as described above. Note that it may be one of options, for example, that the user pulls out the insertion sheets P and stops the binding process by the first stapler 40*a*.

On the other hand, if the binding process by the second stapler 40*b* is selected by the operation unit 80, the alignment member moving mechanism 61 moves the first alignment member 60*a* and the second alignment member 60*b* in the B-direction under control by the post-processing control unit 101, and hence the insertion position of the insertion sheets defined by the first alignment member 60*a* and the second alignment member 60*b* is reset to the position corresponding to the selected second stapler 40*b*, namely the position at which the insertion sheets are directed to the front recess $\mathbf{40}b_1$ of the second stapler 40*b* (see FIG. 5). In more detail, the alignment member moving mechanism 61 moves the first alignment member 60*a* and the second alignment member 60*b* in the B-direction so that they are closer to the frame F2 than the case where the binding process by the first stapler 40*a* is performed.

Figure 12:
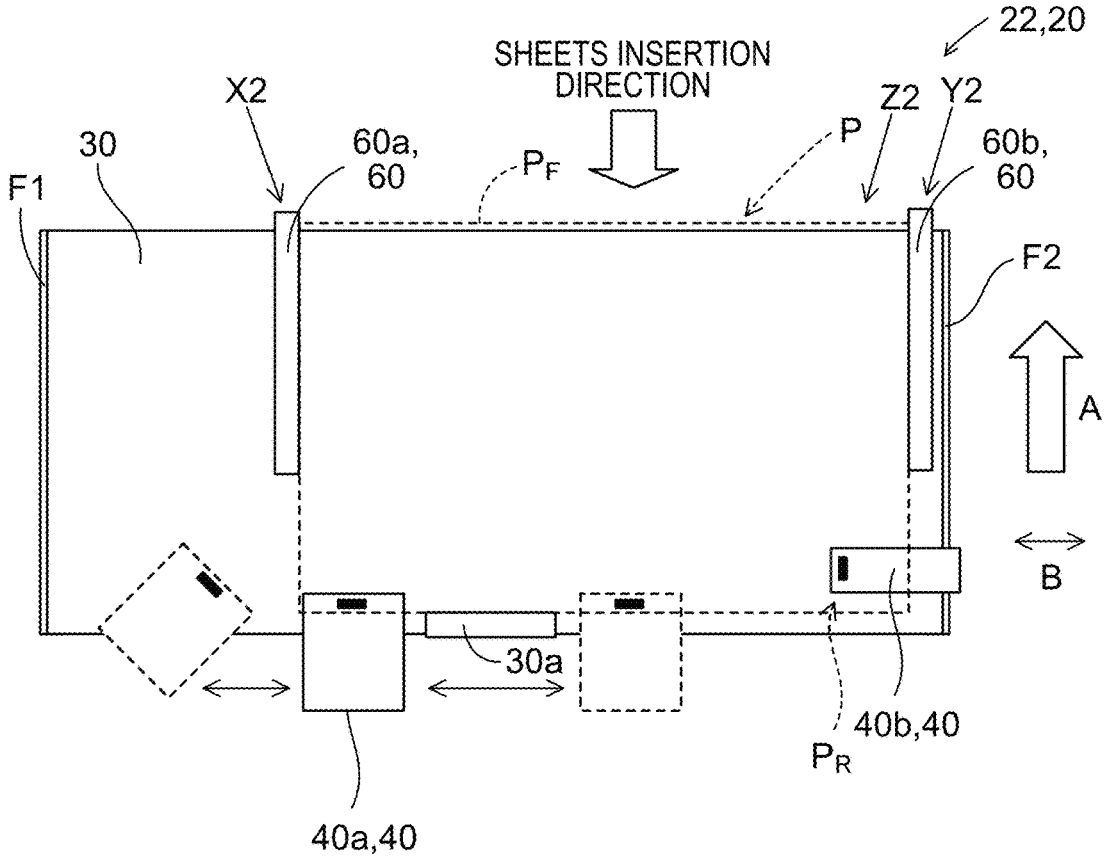
FIG. 12 is a plan view schematically illustrating positions of the plurality of alignment members when the binding process by the second stapler is selected in the manual staple mode.

FIG. 12 schematically illustrates positions of the first alignment member 60*a* and the second alignment member

Figure 13:
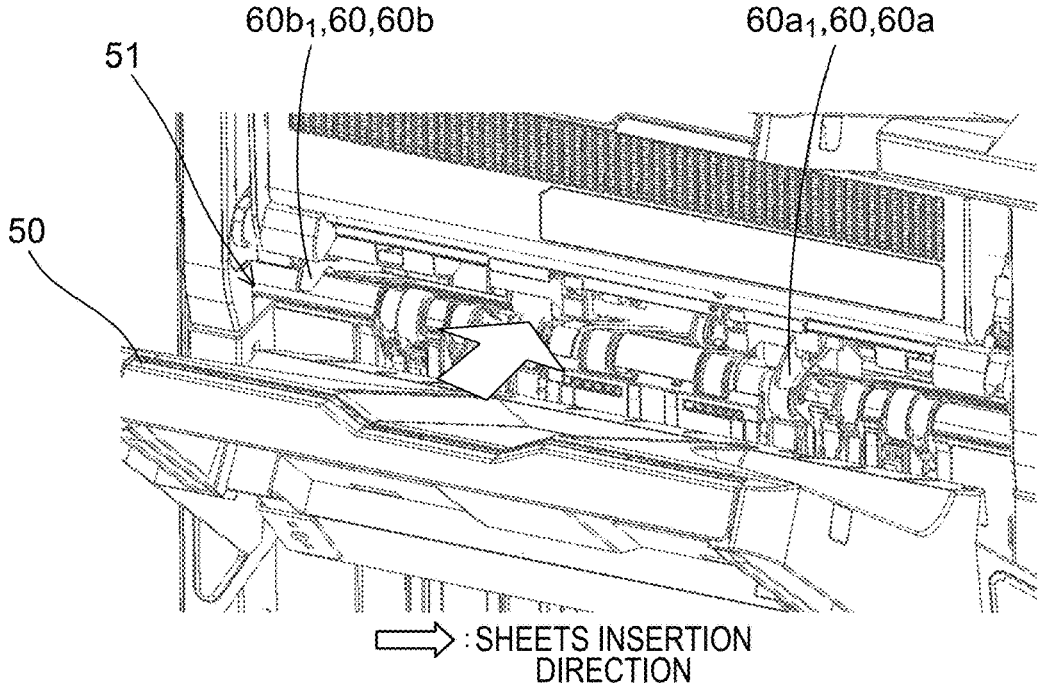
FIG. 13 is a perspective view of the plurality of alignment members illustrated in FIG. 12, viewed from the discharge tray side.

60*b* when the binding process by the second stapler 40*b* is selected in the manual staple mode. Further, FIG. 13 is a perspective view of the first alignment member 60*a* and the second alignment member 60*b* illustrated in FIG. 12, viewed from the discharge tray 50 side. As illustrated in FIGS. 12 and 13, when the first alignment member 60*a* and the second alignment member 60*b* are moved so that the insertion position (second insertion position Z2) of the insertion sheets P is defined, the user can insert the sheets into the second insertion position Z2 between the position X2 of the first alignment member 60*a* and the position Y2 of the second alignment member 60*b* in the B-direction.

Figure 14:
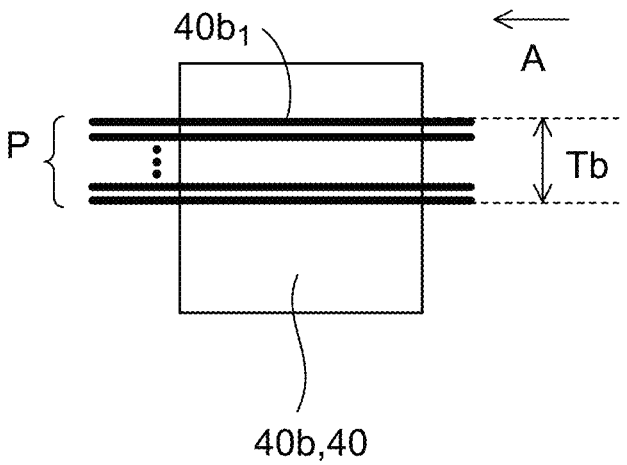
FIG. 14 is a side view of the second stapler viewed from the sheet width direction when the thickness of the insertion sheets is less than or equal to the front recess width of the second stapler.

FIG. 14 is a side view of the second stapler 40*b* viewed from the B-direction when the thickness of the insertion sheets P is less than or equal to the width Tb of the front recess 40$b_1$ of the second stapler 40*b*. If the thickness of the insertion sheets P is less than or equal to the width Tb, all the insertion sheets P are received by the front recess 40$b_1$. In other words, there are no sheets (a part of the insertion sheets P) that cannot enter the front recess 40$b_1$ but protrude largely from the discharge outlet 51 (see FIG. 13). In this way, the user can recognize that the thickness of the insertion sheets P is less than or equal to the thickness that can be bound by the second stapler 40*b*. Therefore, the user can operate the operation unit 80 to instruct execution of the binding process by the second stapler 40*b*, so that the second stapler 40*b* can perform the binding process of the insertion sheets P at the rear edge $P_R$ (see FIG. 12). Note that even in the state where all the insertion sheets P are received in the front recess 40 $b_1$ of the second stapler 40*b*, the end $P_F$ of the insertion sheets P on the insertion side (see FIG. 12) protrudes a little from the second discharge roller pair 29 to the discharge outlet 51 side, and hence the user can grip the end $P_F$ of the insertion sheets P and pull the same, so that the insertion sheets P after the binding process can be pulled out from the sheet post-processing apparatus 20.

Note that the position of the insertion sheets P on the stacking tray 30, in the state where the insertion sheets P are received in the front recess 40$b_1$ of the second stapler 40*b* (the position of the insertion sheets P shown by a broken line in FIG. 12), is the same as the second placing position L2 illustrated in FIG. 6, namely, the position to which the sheets are moved from the first placing position L1, when the binding process by the second stapler 40*b* is performed on the sheets conveyed from the image forming apparatus 100.

Figure 15:
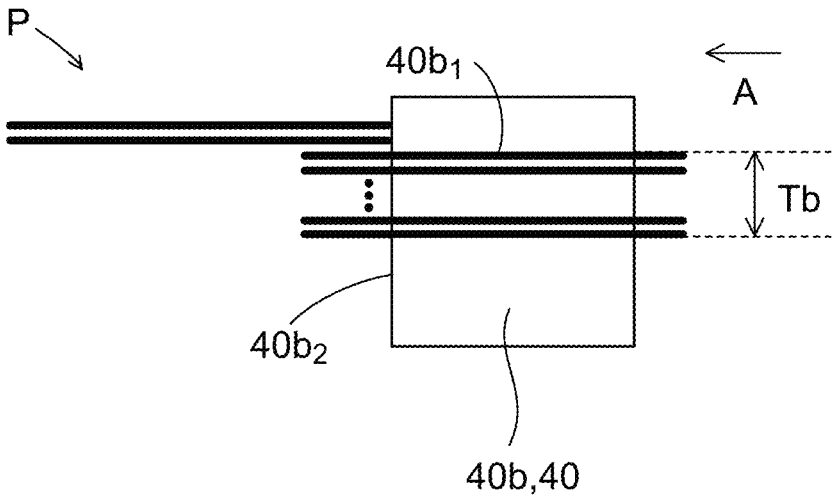
FIG. 15 is a side view of the second stapler viewed from the sheet width direction when the thickness of the insertion sheets is more than the front recess width.

FIG. 15 is a side view of the second stapler 40*b* viewed from the B-direction when the thickness of the insertion sheets P is more than the width Tb. If the thickness of the insertion sheets P is more than the width Tb, a part of the insertion sheets P are received in the front recess 40$b_1$, but some other sheets abut an outer surface 40$b_2$ outside the front recess 40$b_1$ and largely protrude from the discharge outlet 51 to the discharge tray 50 side. Therefore, the user can recognize that the thickness of the insertion sheets P is more than the thickness that can be bound by the second stapler 40*b*. In this case, the user can, for example, reduce the number of the insertion sheets P and inset them again through the discharge outlet 51, and hence the binding process by the second stapler 40*b* can be performed in the same manner as described above. Further, the user can also operate the operation unit 80 and switch the binding process by the second stapler 40*b* to the binding process by the first stapler 40*a*, so that the binding process by the first stapler 40*a* can be performed (in this case, the first alignment member 60*a* and the second alignment member 60*b* are reset to the position illustrated in FIG. 8). Note that it may be one of options, for example, that the user pulls out the insertion sheets P and stops the binding process.

As described above, in the sheet post-processing apparatus 20 of this embodiment, the first stapler 40*a* and the second stapler 40*b* have the different widths Ta and Tb in the thickness direction of the front recess, which sandwich the sheets to be bound (the first sheets S1, the second sheets S2, or the insertion sheets P) in the thickness direction (see FIGS. 4, 5, 10, and 14). In other words, the thickness of the sheets that can be bound is different between the first stapler 40*a* and the second stapler 40*b*. Further, the position on the stacking tray 30 at which the sheets are bound by the first stapler 40*a* (the first placing position L1) and the position on the stacking tray 30 at which the sheets are bound by the second stapler 40*b* (the second placing position L2) are shifted from each other in the B-direction and partially overlap each other (see FIGS. 3, 6, 8, and 12).

In this structure, if the manual staple mode is set with the operation unit 80, and if the stapler 40 is selected for the binding process, the post-processing control unit 101 controls the alignment member moving mechanism 61 to move the plurality of alignment members 60 so that the insertion position of the insertion sheets P is changed to the position corresponding to the selected stapler 40. In more detail, if the first stapler 40*a* is selected as the stapler 40 for performing the binding process in the manual staple mode, using the operation unit 80, the post-processing control unit 101 controls the alignment member moving mechanism 61 to move the alignment members 60 (the first and second alignment members 60*a*, 60*b*) to the positions X1 and Y1, respectively, defining the first insertion position Z1 (see FIG. 8) for guiding the insertion sheets P to the first placing position L1. If the second stapler 40*b* is selected, the post-processing control unit 101 controls the alignment member moving mechanism 61 to move the alignment members 60 to the positions X2 and Y2, respectively, defining the second insertion position Z2 (see FIG. 12) for guiding the insertion sheets P to the second placing position L2.

In this way, when the user inserts the sheets into the insertion position (the first insertion position Z1 or the second insertion position Z2) defined by the plurality of alignment members 60, the user can recognize whether or not the thickness of the insertion sheets P is less than or equal to the thickness that can be bound, on the basis of an insertion state of the insertion sheets P (whether all the insertion sheets P are received inside or some of them are not received). In other words, when the sheets are inserted into the insertion position, it can be easily recognized whether or not the thickness of the inserted sheets is a thickness that can be bound by the selected stapler 40. In this way, the user can adjust the number of the insertion sheets as necessary, so that the binding process by the selected stapler 40 can be securely performed.

In particular, the first stapler 40*a* has the front recess 40$a_1$ as the first entrance for receiving the first sheets S1 to be bound. Further, the second stapler 40*b* has the front recess 40$b_1$ the second entrance for receiving the second sheets S2 to be bound. In this structure, the front recess width of the second stapler 40*b* is less than that of the first stapler 40*a* (Tb<Ta). In other words, the width in the sheet thickness direction of the front recess 40$a_1$ is more than that of the front recess 40$b_1$. In the structure using the first stapler 40*a* and the second stapler 40*b*, the effect of this embodiment described above can be obtained. Further, the relationship of Tb<Ta can bring other effects such that the insertion sheets P having the thickness that the first stapler 40*a* allows can be prevented from being processed by the second stapler 40*b*, and that it is avoided that the thickness of the insertion sheets P that is processed by the first stapler 40*a* is limited by the front recess 40*b*$_1$ of the second stapler 40*b*.

Further, the alignment member moving mechanism 61 moves the plurality of alignment members 60 in the B-direction so that the insertion position of the insertion sheets P to the position at which the insertion sheets P are directed to the front recess of the selected stapler 40. In this way, the sheets inserted into the insertion position can be securely guided to the front recess of the selected stapler 40 for performing the binding process.

Further, the alignment member 60 includes the first alignment member 60*a* and the second alignment member 60*b* whose downstream side ends 60*a*$_1$ and 60*b*$_1$ in the A-direction (the conveying direction of the sheets) are apart from each other in the B-direction (sheet width direction) in the discharge outlet 51. In this case, the space between the first alignment member 60*a* and the second alignment member 60*b* in the B-direction (particularly the space between the end 60*a*$_1$ and the end 60*b*$_1$) can be securely defined as the insertion position of the insertion sheets P (the first insertion position Z1 and the second insertion position Z2). In other words, the first alignment member 60*a* and the second alignment member 60*b* can define the first insertion position Z1 and the second insertion position Z2 of the insertion sheets P. Further, by moving the first alignment member 60*a* and the second alignment member 60*b* in the B-direction, the insertion position of the insertion sheets P can be securely changed to the position corresponding to the selected stapler 40.

Further, in the structure where the second stapler 40*b* is positioned closer to the frame F2 than the first stapler 40*a* in the B-direction, the alignment member moving mechanism 61 moves the first alignment member 60*a* and the second alignment member 60*b* in the B-direction, so that they are closer to the frame F2 when the binding process by the second stapler 40*b* is performed than when the binding process by the first stapler 40*a* is performed (see FIGS. 8 and 12). In this case, the insertion position of the insertion sheets P defined by the first alignment member 60*a* and the second alignment member 60*b* is closer to the frame F2 when the binding process by the second stapler 40*b* is performed than when the binding process by the first stapler 40*a* is performed. Therefore, even in the structure where the second stapler 40*b* is positioned close to the frame F2, the insertion position of the insertion sheets P can be securely distinguished between when the binding process by the first stapler 40*a* is performed and when the binding process by the second stapler 40*b* is performed, for performing the manual stapling process.

Further, the binding process performed by the first stapler 40*a* is a binding process using staples, while the binding process performed by the second stapler 40*b* is a binding process without using staples. The thickness of the sheets (the number of the sheets) that can be bound in the binding process without using staples is usually smaller than that in the binding process using staples. Therefore, in the manual staple mode, for example, the situation where the thickness of the inserted sheets is more than the thickness that can be bound is apt to occur more often when the binding process by the second stapler 40*b* without using staples is performed, than when the binding process by the first stapler 40*a* using staples is performed. Therefore, the structure of this embodiment is very effective, in which it is easily recognized whether or not the thickness of the inserted sheets is a thickness that can be bound by the selected stapler 40 when the sheets are inserted.

Further, the first stapler 40*a* moves in the B-direction, and hence it performs the binding process, at a plurality of positions in the B-direction, on the rear edge $P_R$ of the sheets aligned at the first placing position L1. In this structure in which the first stapler 40*a* is moved in the B-direction to perform the binding process, the number of first staplers 40*a* to be used is less than in the structure in which a plurality of first staplers 40*a* are arranged in the B-direction so that one of them is selected and used for the binding process, and hence the former structure is more advantageous in cost than the latter structure. Therefore, in the structure having both the first stapler 40*a* and the second stapler 40*b*, the effect of this embodiment described above can be obtained.

Note that it is sufficient that the second stapler 40*b* is a stapler that performs the binding process on the sheets at one predetermined position in the B-direction, and it is not limited to the stapler of this embodiment that performs the binding process without using staples. For instance, the second stapler 40*b* may be one that performs the binding process on the sheets using staples of a different type (different depth, width, thickness, material, or the like) from that of the first stapler 40*a*.

Note that this embodiment describes the case where the maximum thickness of the sheets that can be bound by the second stapler 40*b* is less than that by the first stapler 40*a*, but the former may be more than the latter depending on a type of staples to be used (the width of the front recess in the up and down direction of the second stapler 40*b* may be more than that of the first stapler 40*a*). In this case too, the structure described in this embodiment can be applied.

As described above, in this embodiment, in the manual staple mode, when the stapler for the binding process is selected, the control unit controls the insertion position of the insertion sheets defined by the alignment members to change to the position corresponding to the selected stapler. When the insertion sheets having a thickness less than or equal to the width of the front recess of the selected stapler in the thickness direction are inserted into the insertion position, the insertion sheets are received by the front recess of the stapler (there are no sheets that cannot enter the front recess but protrude largely from the discharge outlet), and hence the user can recognize that the thickness of the insertion sheets is less than or equal to the thickness that can be bound. In this case, the user can perform the binding process by the selected stapler. On the contrary, when the insertion sheets having a thickness more than the width of the front recess of the selected stapler in the thickness direction are inserted into the insertion position, a part of the insertion sheets are received in the front recess of the stapler, but other sheets largely protrude from the discharge outlet. In this case, the user can recognize that the thickness of the insertion sheets is more than the thickness that can be bound. For instance, the user can reduce the number of the insertion sheets and inserts the same again, so that the binding process can be performed.

In this way, when the user inserts the sheets into the insertion position defined by the alignment members, the user can easily recognize whether or not the thickness of the sheets is a thickness that can be bound by the selected stapler. In this way, the user can adjust the number of the insertion sheets as necessary, so that the binding process by the selected stapler can be securely performed.

Although the embodiment of the present disclosure is described above, the scope of the present disclosure is not limited to this, but can be modified variously within the scope of the disclosure without deviating from the spirit thereof.

The present disclosure can be used for image forming systems that perform the binding process on the sheets obtained by stacking sheets supplied from the image forming apparatus.

What is claimed is:

1. A sheet post-processing apparatus comprising:

a stacking tray on which a conveyed sheet is stacked;

an alignment member capable of moving in a sheet width direction perpendicular to a conveying direction so as to align a plurality of sheets stacked on the stacking tray;

a first stapler for performing a first binding process to bind on a rear edge of the aligned sheets;

a second stapler for performing a second binding process different from the first binding process to bind on a rear edge of the aligned sheets;

an alignment member moving mechanism for moving the alignment member;

a discharge roller pair for conveying the sheets bound by the stapler so as to discharge the sheets onto a discharge tray through a discharge outlet; and a control unit for controlling the first and second staplers and the alignment member moving mechanism, wherein the alignment member is capable of aligning the sheets at a first placing position on the stacking tray and at a second placing position shifted from the first placing position by a predetermined distance in the sheet width direction, the first stapler performs a first binding process on the sheets placed at the first placing position, and the second stapler disposed outside the first stapler in the sheet width direction performs a second binding process on the sheets placed at the second placing position, the first stapler and the second stapler have different thicknesses of the sheets which can be bound, the control unit controls the first and second staplers to respectively perform the first and second binding processes on the sheets placed on the stacking tray, and is capable of performing a manual staple mode for controlling the first and second staplers to respectively perform the first and second binding processes on sheets inserted onto the stacking tray through the discharge outlet, and in the manual staple mode, if the first stapler is selected as a manual stapler, the control unit controls the alignment member moving mechanism to move the alignment member to a position defining a first insertion position in the discharge outlet for guiding the sheets to the first placing position, while if the second stapler is selected, the control unit controls the alignment member moving mechanism to move the alignment member to a position defining a second insertion position for guiding the sheets to the second placing position.

2. The sheet post-processing apparatus according to claim 1, wherein the alignment member includes a first alignment member and a second alignment member respectively having end portions on the downstream side in the conveying direction, the end portions being positioned apart from each other in the sheet width direction in the discharge outlet, and the end portions of the first alignment member and the second alignment member define the first insertion position and the second insertion position of the sheets.

3. The sheet post-processing apparatus according to claim 1, wherein the first stapler and the second stapler respectively have a first entrance and a second entrance for receiving the rear edge of the sheets to be bounded, and a width in a thickness direction of the first entrance is more than that of the second entrance.

4. The sheet post-processing apparatus according to claim 1, wherein the first stapler is a stapler that binds with a staple, and the second stapler is a staple-free stapler without using a staple.

5. The sheet post-processing apparatus according to claim 1, wherein the first stapler moves in the sheet width direction so as to perform the first binding process at a plurality of positions in the sheet width direction on the rear edge of the sheets aligned at the first placing position.

6. An image forming system comprising:

the sheet post-processing apparatus according to claim 1; and an image forming apparatus for forming an image on the sheet so as to supply the sheet to the sheet post-processing apparatus.

* * * * *